US010526904B2

(12) United States Patent
Weinert et al.

(10) Patent No.: US 10,526,904 B2
(45) Date of Patent: Jan. 7, 2020

(54) ROTOR WITH OVERHANG AT BLADES FOR A LOCKING ELEMENT

(71) Applicant: Rolls-Royce Deutschland Ltd & Co KG, Blankenfelde-Mahlow (DE)

(72) Inventors: Markus Weinert, Rangsdorf (DE); Tobias Leymann, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 336 days.

(21) Appl. No.: 15/490,242

(22) Filed: Apr. 18, 2017

(65) Prior Publication Data

US 2017/0306771 A1 Oct. 26, 2017

(30) Foreign Application Priority Data

Apr. 20, 2016 (DE) ..... 10 2016 107 315

(51) Int. Cl.
*F01D 5/02* (2006.01)
*F01D 5/32* (2006.01)
*F01D 5/12* (2006.01)

(52) U.S. Cl.
CPC ..... *F01D 5/326* (2013.01); *F01D 5/02* (2013.01); *F01D 5/12* (2013.01); *F05D 2220/32* (2013.01);

(Continued)

(58) Field of Classification Search
None
See application file for complete search history.

(56) References Cited

U.S. PATENT DOCUMENTS 2,755,063 A * 7/1956 Wilkinson ..... F01D 5/3015 192/105 BA
3,096,074 A * 7/1963 Pratt ..... F01D 5/3015 416/215

(Continued)

FOREIGN PATENT DOCUMENTS

EP 2860350 A1 4/2015
EP 2873807 A1 5/2015
GB 2258273 A 2/1993

OTHER PUBLICATIONS

European Search Report dated Aug. 18, 2017 from counterpart European App No. 17166817.1.

(Continued)

*Primary Examiner* — Carlos A Rivera
*Assistant Examiner* — Theodore C Ribadeneyra
(74) *Attorney, Agent, or Firm* — Shuttleworth & Ingersoll, PLC; Timothy J. Klima

(57) ABSTRACT

A rotor for an engine is provided. The rotor comprising a rotor base part that has fastening grooves for rotor blades that are arranged in succession around a rotational axis along a circumferential direction, multiple rotor blades that are respectively supported in a form-fit manner inside a corresponding fastening groove by means of a blade root, and at least one securing element for the axial securing—with respect to a rotational axis of at least one of the rotor blades at the rotor base part.

The at least one securing element has two edges that are arranged at a radial distance to one another and through which the securing element is supported in a form-fit manner at the rotor base part, on the one hand, and, on the other hand, at the at least one rotor blade.

19 Claims, 13 Drawing Sheets

(52) U.S. Cl.
CPC ..... *F05D 2250/11* (2013.01); *F05D 2250/13* (2013.01); *F05D 2250/14* (2013.01)

(56) References Cited

U.S. PATENT DOCUMENTS

| | | | | |
|---|---|---|---|---|
| 3,137,478 | A * | 6/1964 | Farrell | F01D 5/3015 416/193 A |
| 3,501,249 | A * | 3/1970 | Scalzo | F01D 5/3015 416/95 |
| 3,656,865 | A * | 4/1972 | Spears, Jr. | F01D 5/3015 416/220 R |
| 3,807,898 | A * | 4/1974 | Guy | F01D 5/3015 416/218 |
| 4,480,958 | A * | 11/1984 | Schlechtweg | F01D 11/006 416/219 R |
| 4,648,799 | A * | 3/1987 | Brown | F01D 5/3015 416/220 R |
| 5,256,035 | A | 10/1993 | Norris et al. | |
| 6,520,743 | B2 * | 2/2003 | Arilla | F01D 5/3015 416/204 A |
| 7,762,112 | B2 * | 7/2010 | Brucher | B21D 39/02 29/889.21 |
| 8,096,776 | B2 * | 1/2012 | Bluck | F01D 5/3015 416/219 R |
| 10,060,276 | B2 * | 8/2018 | Tanaka | F01D 11/003 |
| 2006/0182624 | A1 * | 8/2006 | London | F01D 5/225 415/170.1 |
| 2006/0188377 | A1 | 8/2006 | Dixon et al. | |
| 2008/0181767 | A1 * | 7/2008 | Brillert | F01D 5/081 415/170.1 |
| 2008/0181768 | A1 * | 7/2008 | Brucher | F01D 5/3015 415/170.1 |
| 2009/0116965 | A1 | 5/2009 | Brillert et al. | |
| 2012/0034087 | A1 * | 2/2012 | Dungs | F01D 5/3015 416/219 R |
| 2014/0356177 | A1 * | 12/2014 | Snyder | F01D 5/3015 416/220 R |
| 2015/0059357 | A1 * | 3/2015 | Morgan | F01D 5/081 60/806 |
| 2015/0147158 | A1 * | 5/2015 | Wang | F01D 5/187 415/115 |
| 2015/0300192 | A1 * | 10/2015 | Smoke | F01D 11/005 415/116 |
| 2015/0315930 | A1 * | 11/2015 | Koonankeil | F01D 25/12 415/116 |
| 2016/0053688 | A1 * | 2/2016 | Suciu | F01D 25/24 415/177 |
| 2016/0090850 | A1 * | 3/2016 | Barry | F01D 5/081 416/221 |
| 2016/0090854 | A1 * | 3/2016 | Webb | F01D 5/081 416/220 R |
| 2016/0177750 | A1 * | 6/2016 | Berger | F01D 5/326 416/220 R |
| 2016/0245107 | A1 | 8/2016 | Dungs et al. | |
| 2016/0265378 | A1 | 9/2016 | Dungs et al. | |
| 2016/0348510 | A1 * | 12/2016 | Griffin | F01D 5/082 |

OTHER PUBLICATIONS

German Search Report dated Mar. 30, 2017 for counterpart German Application No. DE 10 2016 107 315.6.

* cited by examiner

ROTOR WITH OVERHANG AT BLADES FOR A LOCKING ELEMENT

REFERENCE TO RELATED APPLICATION

This application claims priority to German Patent Application No. 10 2016 107 315.6 filed on Apr. 20, 2016, the entirety of which is incorporated by reference herein.

BACKGROUND

The invention relates to a rotor for an engine, in particular for a gas turbine engine.

A generic rotor as it is for example known from U.S. Pat. No. 5,256,035 has a rotor base part that has fastening grooves for rotor blades that are arranged in succession along a circumferential direction around a rotational axis. At that, the individual rotor blades are supported in a form-fit manner inside corresponding fastening grooves by means of a blade root, respectively. For the purpose of axial securing with respect to the rotational axis, a single-part or multi-part securing element is provided that is supported in a form-fit manner at at least one of the rotor blades at a radially outer edge, and is supported in a form-fit manner at the rotor base part at a radially inner edge.

For example, in U.S. Pat. No. 5,256,035 a multi-part securing element is provided that consists of multiple plate segments and a mounting ring. At that, a radially inner edge of the individual plate segments is received in a form-fit manner inside a groove of the rotor base part, so that a projection of the rotor base part that extends radially outward respectively surrounds the radially inner edge of the plate segments. The mounting ring is in turn received inside a groove that is respectively formed at a blade base of a rotor blade. At that, a projection of the blade base that extends radially inward surrounds the radially outer edge of the mounting ring, thereby also securing a plate segment that is arranged adjacent to and in the axial direction next to the mounting ring.

However, when it comes the individual projections of the multiple rotor blades that are connected to the rotor base part, undesired turbulences may occur in the area of two adjacent projections during operation of the rotor, in particular in the case of a fast-rotating and highly loaded rotor as it is used in a gas turbine engine, for example in the high-pressure compressor or the high-pressure turbine. This is illustrated in more detail in FIGS. 5A, 5B, 5C and 5D, which respectively show sections of a rotor as it is known from the state of the art.

Here, the rotor comprises a rotor base part in the form of a rotor disc 2 with multiple fastening grooves 20 that are arranged at a distance to one another along a circumferential direction U. A blade root 32 of a rotor blade 3*a*, 3*b* is received inside each fastening groove 20. Of the plurality of rotor blades that are arranged behind each other along the circumference of the rotor (for example 20 pieces), respectively only two are shown in sections in FIGS. 5A, 5B, 5C and 5D, as viewed along the rotational axis of the rotor. Each rotor blade 3*a*, 3*b* has a blade base 31, of which respectively one blade leaf 30 projects radially. In a radially inwardly oriented direction ri, the blade root 32 extends from the blade base 31.

The blade base 31 of a rotor blade 3*a* or 3*b* respectively forms a projection 310 that extends radially inwards, i.e. along the inwardly oriented radial direction ri. A radially outer edge 43 of a securing plate 4 is surrounded by this projection 310. Through this securing plate 4, multiple (at least two) rotor blades 3*a* and 3*b* are secured at the rotor base part 2 in the axial direction in the area of the fastening grooves 20. For this purpose, the securing plate 4 is connected not only to the rotor blades 3*a* and 3*b*, but also to the rotor base part 2. For providing a form-fit connection between the rotor base part 2 and the securing plate 4, a projection of the rotor base part 2, that is not shown in the FIGS. 5A to 5C, surrounds a radially inner edge 42 of the securing plate 4. The longitudinally extending securing plate 4 that extends in the circumferential direction is thus supported at its radially outer edge 43 as well as at the radially inner edge 42, and is respectively received inside a groove that is formed by a rotor blade 3*a*, 3*b* or the rotor base part 2.

As can in particular be seen from FIG. 5A, a rotor blade 3*a*, 3*b* as it is known from the state of the art respectively forms a projection 310 for surrounding the radially outer edge 43 of the securing plate 4 that is formed over a total length L along the circumferential direction U [by] an edge 311 extending in a continuously linear or circular-arc-shaped manner. Thus, at a pair of rotor blades 3*a* and 3*b* that are arranged so as to adjoin each other, their respective projections 310 of adjoining edges 311 should align with each other along the circumferential direction U, so that the radially inner lower edges of these edges 311 lie on a circular orbit around the rotational axis M of the rotor.

However, as is illustrated in FIGS. 5B and 5C, that is actually often not the case in practice. Thus, due to the tolerances to be admitted, it may occur that the individual projections 310 of adjacent rotor blades 3*a*, 3*b* are radially offset with respect to one another. Here, FIGS. 5B and 5C respectively show an offset g of the two rotor blades 3*a* and 3*b* in the area of their projections 310 in an exemplary manner. At that, in the variant of FIG. 5B, the one (left) rotor blade 3*b* is offset radially inward with respect to the adjacent (right) rotor blade 3*a*. The one projection 310 of the one rotor blade 3*b* thus protrudes into the annular gap flow in the circumferential direction U (offset "into wind") with respect to a rotational axis of the rotor about the rotational axis M along the circumferential direction. In the variant of FIG. 5C, the one (left) rotor blade 3*b* is offset radially outward with respect to the other (right) rotor blade 3*a* (offset "out of wind"). The edge 311 of the projection 310 of the one rotor blade 3*b* is thus completely offset radially outward with respect to the projection 310 of the other rotor blade 3*a*.

Although it is observed in practice that an offset g for both cases lies only in the range of 0.2 mm to 0.4 mm in a rotor, undesired turbulences may occur here in the area of adjoining blade bases 31 and thus in adjoining projections 310, especially in fast-spinning rotors for a gas turbine engine, for example in a rotor of a high-pressure turbine or a high-pressure compressor.

SUMMARY

The invention is based on the objective to improve a rotor with regard to this aspect.

This objective is achieved with a rotor with features as described herein.

What is proposed according to the invention is a rotor with a specially designed projection at at least one rotor blade that is connected to the rotor base part in a form-fit manner. Here, the projection has at least one edge section along its extension in the circumferential direction, surrounding a (radially outer) edge of the securing element and recessed in the radially outwardly oriented direction at a radially inner lower edge of the projection with respect to at least one further edge section of the projection that also surrounds the edge of the securing element.

Consequently, in a rotor according to the invention, the projection of at least one rotor blade is recessed or backset in such a manner at a lower edge of the projection in the radially outwardly oriented direction that the projection does not have a linear or circular-arc-shaped course along the circumferential direction at a radially inner lower edge. This in particular includes the configuration of an edge section with a radial offset to an adjoining edge section of the same projection as well as the configuration of an edge section with a radial extension that continuously decreases in the circumferential direction and thus defines an area of the lower edge of the projection that extends obliquely with respect to the circumferential direction. What is thus formed are for example areas that are radially offset and/or that extend at an angle with respect to one another at a radially inner lower edge of a projection. In this manner, a recess is defined from the beginning, preferably in the area of adjoining projections. This may lead to the minimizing or avoidance of interfering turbulences in the area of the securing element, in particular if dimensions are chosen appropriately. Further, a weight reduction as well as a simplification during mounting and/or dismounting of a rotor blade can be achieved, the latter by forming and arranging the at least one recessed edge section in such a manner along the circumferential direction that at least one part of the projection can be pushed through the fastening groove in the axial direction when the securing element is either not yet or no longer attached at the rotor base part.

The at least one radially outwardly recessed edge section can have a smaller extension in the radially inwardly oriented direction than an adjacent edge section. Thus, in the area of the recessed edge section, the projection extends radially inward to a lesser extent.

In an exemplary embodiment, the at least one radially outwardly recessed edge section is provided at an end of the projection that is positioned towards the circumferential direction. In this manner, a defined recess is provided through the recessed edge section in that area in which two neighboring rotor blades adjoin with their blade bases.

In an exemplary embodiment, the at least one radially outwardly recessed edge section forms an area at the radially inner lower edge of the projection that extends in an at least partially tilted manner with respect to the circumferential direction. Accordingly, the recessed edge section can be embodied not only so as to be backset in a stepped manner with respect to an adjoining edge section of the projection, but can also form a recess that continuously increases or decreases in the circumferential direction at least in certain sections.

It has been shown that, in order to reduce turbulences, a certain minimum size is advantageous for the radially outwardly orientated backset of the edge section of a rotor blade overhang for certain purposes of application and in particular for certain rotational speeds of the rotor. In this context, it is provided in one exemplary embodiment that the at least one radially outwardly recessed edge section extends with a length along the circumferential direction of the rotor that corresponds to at least three times, in one variant at least four times, a height by which the radially outwardly recessed edge section is (at least) recessed with respect to an adjoining edge section of the projection. Given a minimal height b by which the at least one edge section is recessed radially outwardly with respect to an adjoining edge section of the projection, i.e. in a radially outwardly orientated direction, and a length a by which the at least one recessed edge section extends along the circumferential direction, what follows is: $a \geq 3b$.

Alternatively or additionally, the at least one radially outwardly recessed edge section is recessed with respect to an adjoining edge section of the rotor blade overhang by at least a height of 0.5 mm, in particular by at least a height of 0.8 mm or 1 mm. Thus, a recess is formed through the recessed edge section which has a maximal depth of at least 0.5 mm, 0.8 mm or 1 mm at a nominal orientation of two adjacent rotor blades.

In one variant, the projection of a rotor blade of the rotor can have two edge sections, namely a first and a second edge section, that are respectively recessed in the radially outwardly orientated direction with respect to at least one further third edge section of the projection that also encloses the edge of the securing element. The first edge section and the second edge section are thus spatially separated from each other and arranged at a distance from each other along the circumferential direction, but are respectively recessed radially outward with respect to at least one third edge section of the rotor blade overhang.

At that, the two recessed edge sections can be recessed to different extents and/or can extend with different lengths along the circumferential direction. Thus, the projection of a rotor blade can be designed so as to be asymmetrical with respect to a radial direction. This for example facilitates a recess design that is optimized with respect to the rotational direction, being formed by two adjacent and respectively radially outwardly recessed edge sections of two neighboring rotor blades.

In particular with a view to such a variant, it can be provided that the first and second radially outwardly recessed edge sections of a rotor blade are provided at ends of the corresponding projection (and a blade base of the corresponding rotor blade) that are arranged at a distance from each other along the circumferential direction. Thus, in neighboring rotor blades and adjacent blade bases, a second edge section of a (first) rotor blade overhang and a first edge section of another (second) rotor blade overhang adjoin each other along the circumference of the rotor. In this way, projections with adjacent and respectively radially outwardly recessed edge sections can be provided at at least two rotor blades of the rotor that are arranged adjacent to each other along the circumferential direction. In this manner, a radially outwardly orientated recess of a defined minimum length and minimum height is formed in the area of the edge sections of two neighboring rotor blades which are adjacent to each other. Thus, a targeted interruption of a circular-orbit-shaped course of the edges of the individual projections that are arranged in succession along the circumferential direction is provided at the radial recess.

In one variant, at least one of the first and the second radially outwardly recessed edge sections is recessed with respect to the adjoining third edge section of the rotor blade overhang by at least the sum of the shape and positional tolerances [of this] third edge section. Thus, a recess is formed by means of a recessed first or second edge section that has a maximal (radial) depth of at least the sum of the shape and positional tolerances of the third edge section in the case of a nominal orientation of two adjacent rotor blades. Here, a nominal position of the third edge section with respect to the corresponding fastening groove and/or with respect to a projection of a neighboring rotor blade of the rotor is predefined by the shape and positional tolerances.

Here, a recess that is defined in the area of the blade bases of two neighboring rotor blades may for example be elliptical, trapezoid or triangular as viewed along the rotational axis.

Projections with adjacent and respectively radially outwardly recessed edge sections can be provided at each pair of adjacent rotor blades along the circumferential direction of the rotor, so that respectively one radially outwardly oriented recess of a defined minimum length and minimum height is formed along the circumferential direction in the area of adjacent edge sections of two neighboring rotor blades. Thus, in this variant, the embodiment of a recess is not limited to individual rotor blade pairs, but is rather provided throughout in each area of two neighboring rotor blades.

The at least one radially outwardly recessed edge section can for example be provided by means of mechanical material removal. This includes manufacture by means of a cutting manufacturing method, such as for example sanding or milling. Accordingly, in such a variant material can be removed in a targeted manner at the projection of a rotor blade base, for example it can be sanded off in order to achieve that a radially inner lower edge of the projection does no longer have a linear course.

Alternatively, a radially outwardly recessed edge section can be manufactured by means of thermal material removal. For example, it can be provided in this context that the manufacture is carried out by means of erosion. This includes manufacture by means of electrical discharge machining, whereby a recessed edge section can also be subsequently created at a projection from a high-strength material in a comparatively simple manner. Here, it can be provided that the (thermal) material removal occurs at the projection for creating a backset edge section in a single working step together with the manufacture of certain functional areas at a rotor blade. For example, it is customary to manufacture a functional area, such as for example a damper pocket or a blade base area that is provided with at least one recess for the purpose of weight reduction, by means of erosion at a rotor blade in the area of the blade base. In such a work step, also the projection of a rotor blade can subsequently be correspondingly processed in order to provide a radially outwardly recessed edge section thereat.

Generally, the at least one securing element can be provided for the axial securing of at least two rotor blades. At that, a securing element with a preferably plate-shaped design is surrounded by projections of at least two rotor blades at a (radially outer) edge.

BRIEF DESCRIPTION OF THE DRAWINGS

The attached Figures illustrate possible embodiment variants of the invention in an exemplary manner.

DETAILED DESCRIPTION

Figure 6:
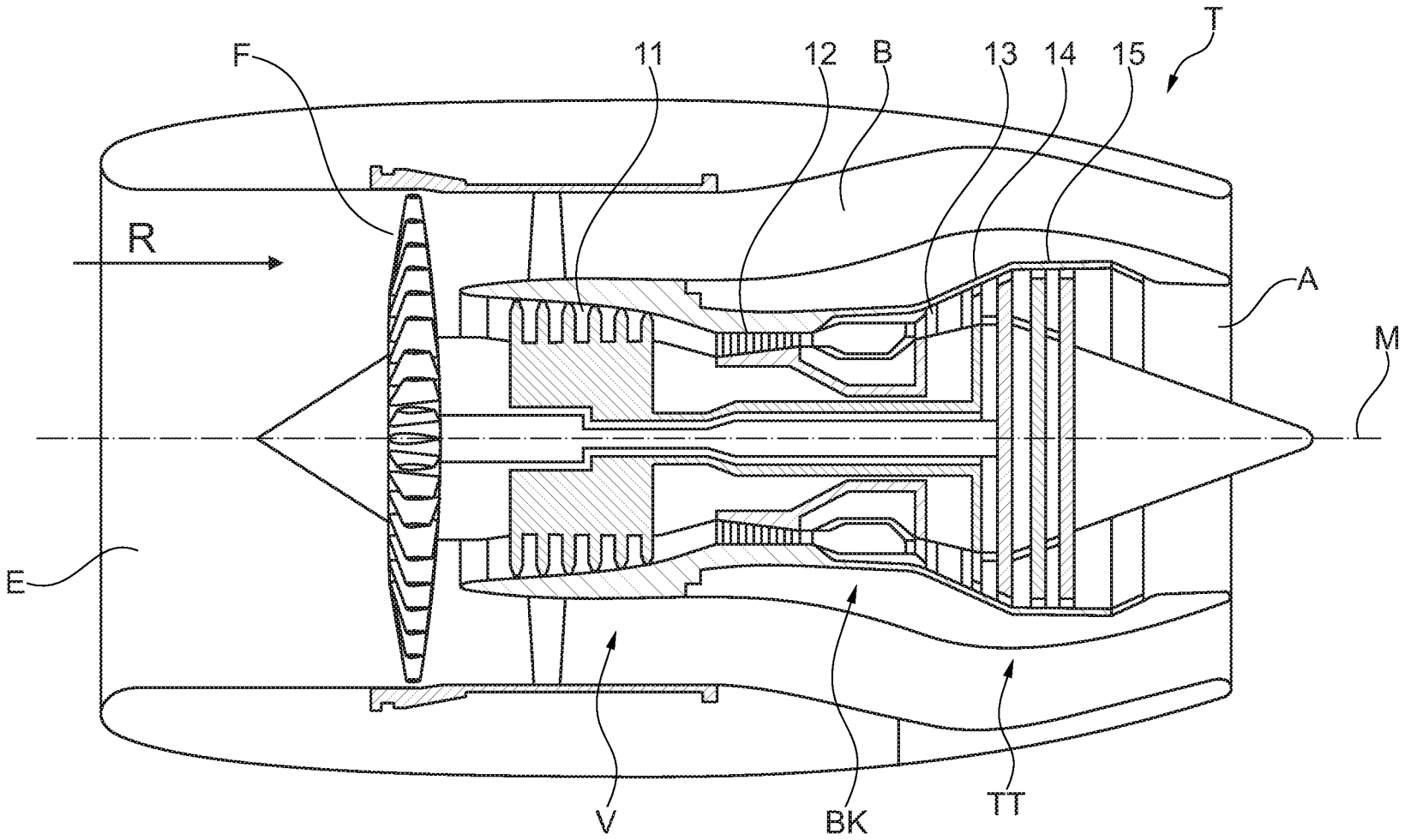
FIG. 6 schematically shows a sectional rendering of a gas turbine engine in which a rotor according to the invention is used.

FIG. 6 schematically illustrates, in a sectional rendering, a (gas turbine) engine T in which the individual engine components are arranged in succession along a central axis or a rotational axis M. By means of a fan F, air is suctioned in along an entry direction E at an inlet or an intake E of the engine T. This fan F is driven by a shaft that is set into rotation by a turbine TT. Here, the turbine TT connects to a compressor V, which for example has a low-pressure compressor 11 and a high-pressure compressor 12, and where necessary also a medium-pressure compressor. The fan F supplies air to the compressor V, on the one hand, and, on the other hand, to a bypass channel B for generating a thrust. The air that is conveyed via the compressor V is eventually transported inside the combustion chamber section BK where the driving power for driving the turbine TT is generated. For this purpose, the turbine TT has a high-pressure turbine 13, a medium-pressure turbine 14, and a low-pressure turbine 15. The turbine TT drives the fan F by means of the energy that is released during combustion in order to then generate the necessary thrust by means of the air that is conveyed into the bypass channel B. The air is discharged from the bypass channel B in the area of an outlet A at the end of the engine T where the exhaust gases flow out of the turbine TT in the outward direction, with the outlet A usually having a thrust nozzle.

In particular in the area of the high-pressure turbine 13, at least one rotor with the configuration as it has been described in the introduction in connection with FIGS. 5A to 5D is used. Here, the rotor is arranged and mounted so as to be rotatable about the central axis or rotational axis M, namely in such a manner that the individual securing plates 4 that are provided along the circumferential direction U for the axial securing of the rotor blades 3*a*, 3*b* are arranged at the downstream front side of the rotor 2. The individual securing elements 4 are thus facing towards an annular space 5 that is formed in the area of the blade roots 32 of the individual rotor blades 3*a*, 3*b* between the rotor and a guide vane arrangement 6. As has been described above, in a configuration of the projections 310 of the blade bases 31 used for providing the connection between the rotor blades 3*a*, 3*b* and a securing element 4, the flow that is created inside this annular space 5 can be subject to undesirable turbulences if individual projections 310 are arranged in a manner offset with respect to one another due to tolerances. In that case, individual projections 31 completely protrude into the flow channel which is defined in a circular manner about the rotational axis along the securing plates 4, or they are radially outwardly offset with respect to the same (cf. FIGS. 5B and 5C).

Here, an improvement can be achieved with the solution according to the invention. According to it, a projection 310 that is provided for the form-fit connection to a radially outer edge 43 of a multi-part or single-part securing element, such as a securing plate 4, is formed with an edge section of a defined geometry and size that is recessed in the radially outer direction ra. Thus, with the solution according to the invention, it can be excluded that a linear or circular-arc-shaped course of the lower edges of the projections 310 arranged in succession along the circumferential direction U and located radially inside is present at each pair of neighboring rotor blades 3*a*, 3*b*, even in a nominal arrangement of the individual rotor blades 3*a*, 3*b* with respect to one another. Rather, at least one defined radial recess is provided from the outset, influencing the flow as little as possible, but in any case doing so in a predictable manner. Preferably, multiple recesses that are distributed along the circumferential direction U are provided, in particular at every pair of blade bases 31 that are arranged adjacent to each other.

Figure 1A:
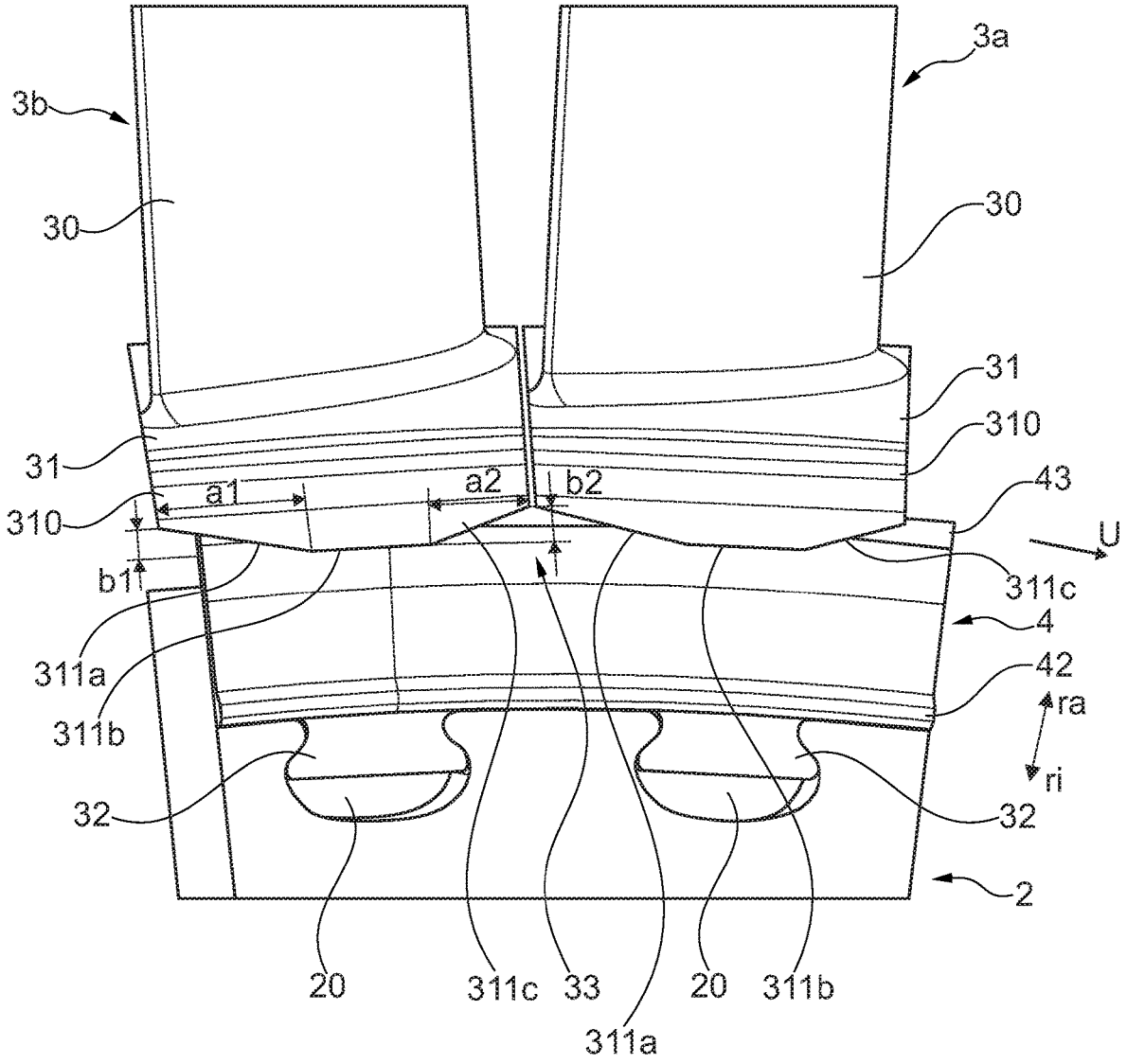
FIG. 1A shows, in sections, a rotor that is designed according to the invention, with a view along a rotational axis of the rotor of two projections of two neighboring rotor blades of the rotor that are radially outwardly recessed in certain sections.
Figure 1B:
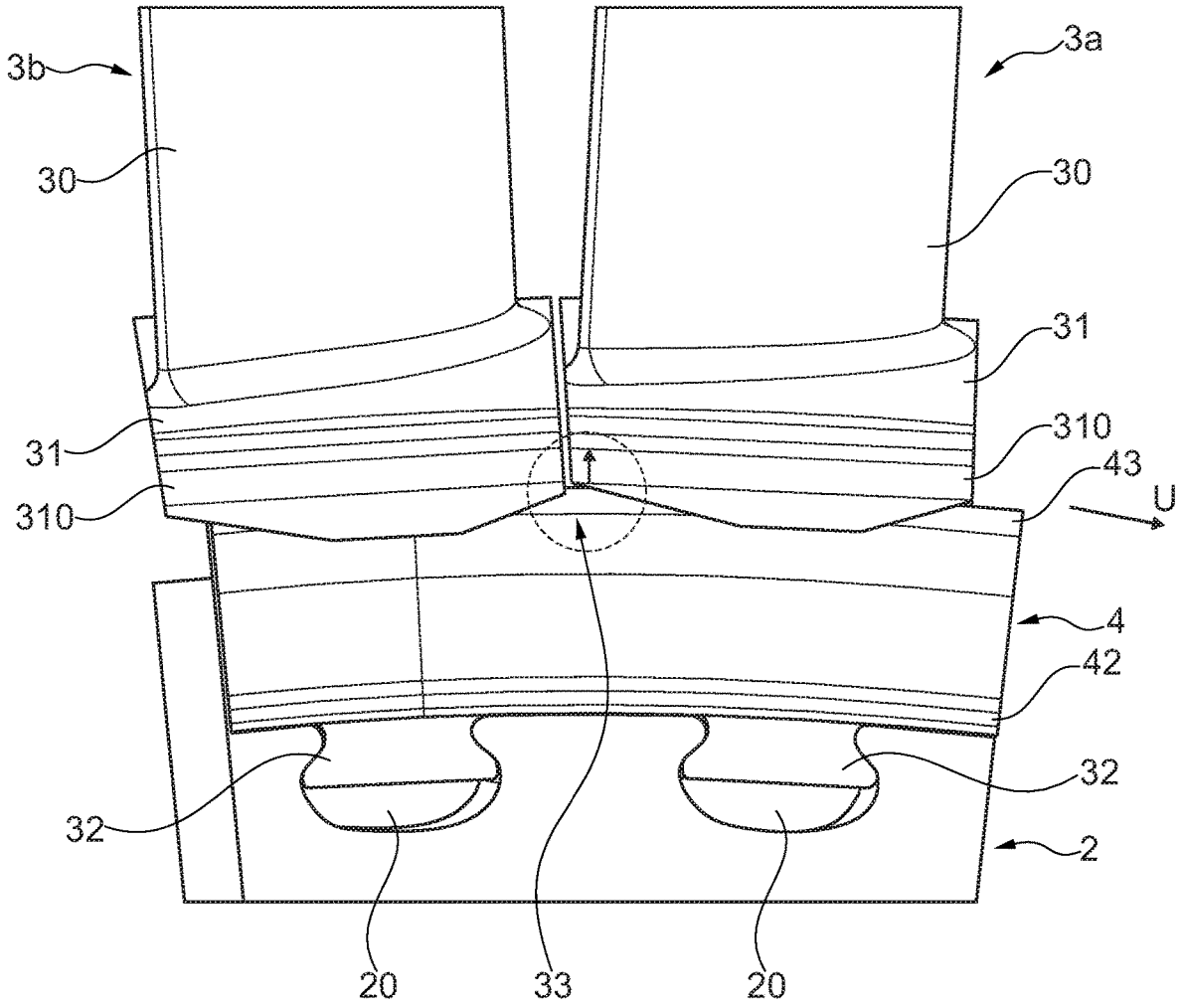
FIG. 1B shows, in a view that corresponds to the one of FIG. 1A, a radial offset between two blade bases of the neighboring rotor blades with respect to the nominal orientation of the two rotor blades to each other as shown in FIG. 1A.
Figure 1C:
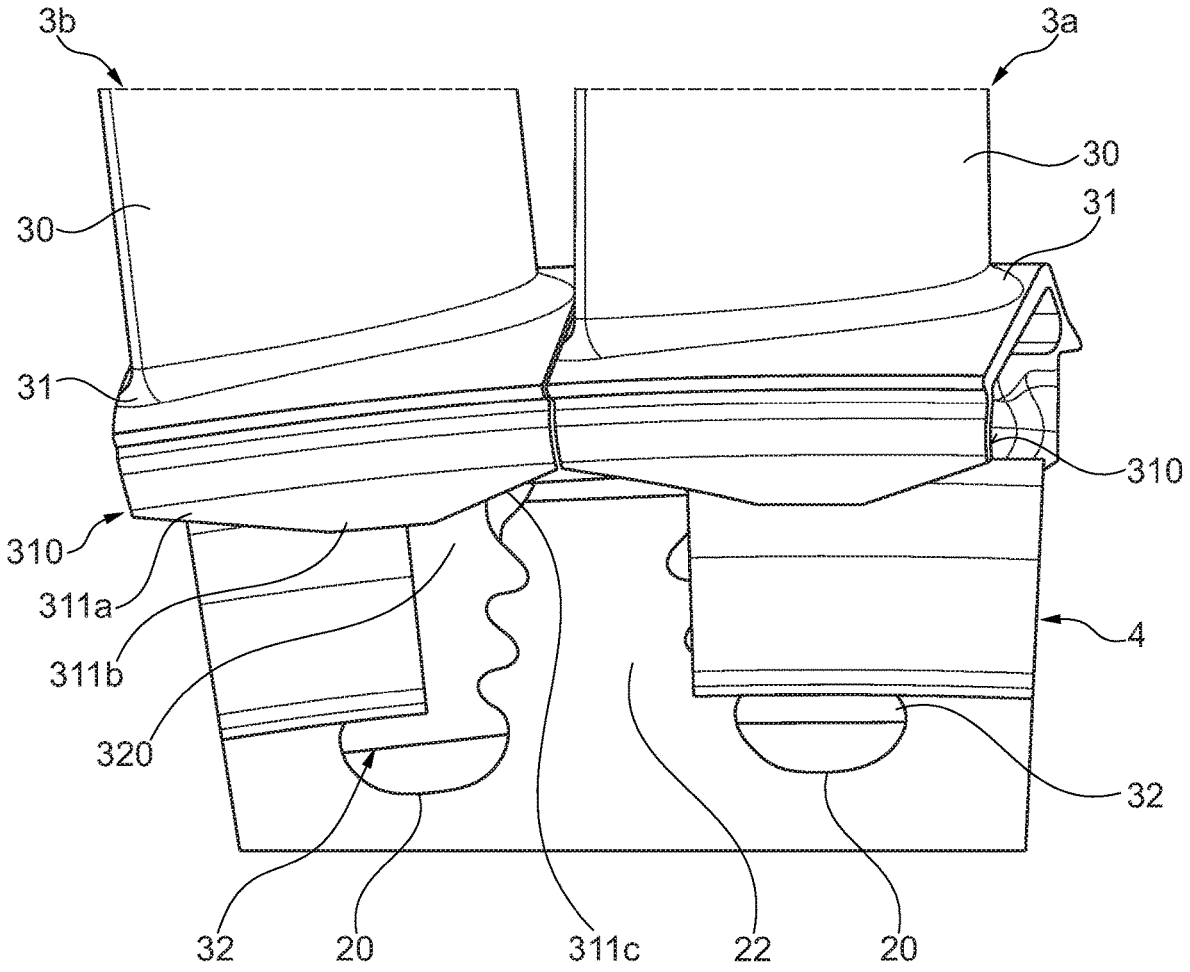
FIG. 1C shows, in a view that corresponds to the one of FIG. 1A, the rotor, with a securing element being partially omitted for the purpose of illustrating a blade neck of a rotor blade that is inserted into a fastening groove.
Figure 1D:
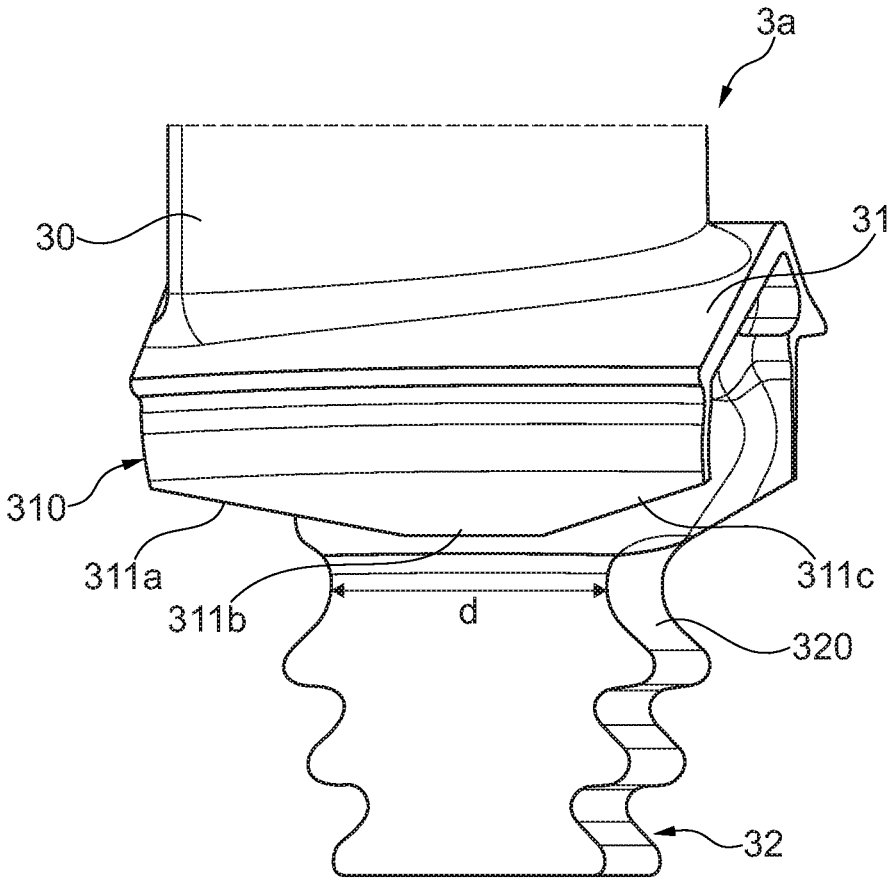
FIG. 1D shows a rotor blade as a detail drawing.

For example, in the embodiment variant of FIGS. 1A to 1C, a projection 310 of a blade base 31 of each rotor blade 3*a*, 3*b* that is fixated at the rotor base part 2 has two radially outwardly recessed edge sections 311*a* and 311*c*. These two radially recessed edge sections 311*a* and 311*c* have a smaller extension in the radially inwardly oriented direction ri than a third edge section 311*b* that is formed in between them. Here, the length of the third edge section 311*b* along the circumferential direction U can be at least twice the shape and positional tolerances of a gap between the axial securing elements 4, and/or at least half the minimum width d of a blade neck 320 of the blade root 32 of a rotor blade 3*a* or 3*b* that is inserted into the corresponding fastening groove 20 (cf. the detail drawing of a rotor blade 3*a* of FIG. 1D). Here, the length of the third edge section 311*b* along the circumferential direction U is less than 60%, where applicable less than 50%, or even less than 35% of the total length L of a projection 310 along the circumferential direction U.

Respectively one recessed edge section 311*a* or 311*c* is provided at the ends of a projection 310 that are positioned at a distance from each other along the circumferential direction U. Here, the edge sections 311*a* and 311*c* extend in the circumferential direction U with different lengths a1 and a2. Both recessed edge sections 311*a* and 311*c* further form an area of the lower edge of the projection 310 that extends in a tilted manner with respect to the circumferential direction U. Here, each recessed edge section 311*a*, 311*c* extends starting from the middle third edge section 311*b* and obliquely outward towards the respective end, so that a radial extension of the respective recessed edge section 311*a* or 311*c* constantly decreases towards the respective lateral edge of the projection 310.

Here, the individual edge sections 311*a* and 311*c* are recessed respectively up to a height b1 or b2 with respect to the middle edge section 311*b*. In the present case, this height b1 or b2 is more than 0.8 mm, amounting to approximately 1 mm. The extension in the circumferential direction U of the respective recessed edge section 311*a*, 311*c* is in turn calculated as a—preferably integral—multiple of this height b1 or b2. In the present case, the length a1, a2 corresponds to at least three times the height b1 or b2 of the respective recessed edge section 311*a*, 311*c*.

The heights b1 and b2 of the recessed edge sections 311*a* and 311*c* are dimensioned in such a manner that, in the area of adjacent rotor blades 3*a*, 3*b* and thus of adjacent blade bases 31, respectively one radial recess 33 is formed in the course of the lower edges of multiple securing plates 4 that are successive in the circumferential direction U, namely by two recessed edge sections 311*c* and 311*a* extending obliquely towards one another. This radial recess 33 is dimensioned in such a manner through the recessed edge sections 311*c* and 311*a* of the individual rotor blades 3*a* and 3*b* that, also with a maximum radial offset g of two rotor blades 3*a* and 3*b* due to tolerances, a radial depth of the respective recess 33 is larger than the offset g, and preferably corresponds to four times the offset g. In this manner, any (relevant) impact on the flow due to the offset g is either excluded or is minimal (cf. FIG. 1B).

Figure 3:
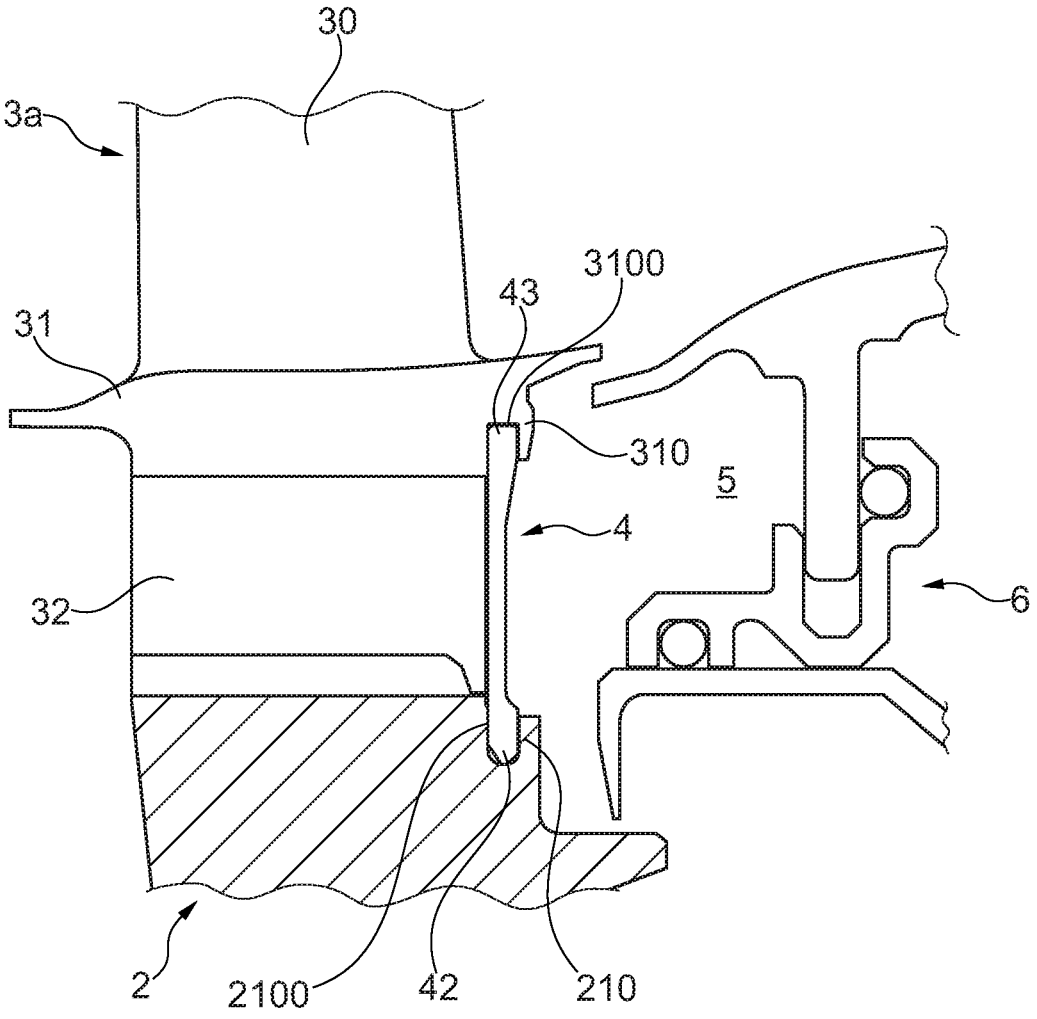
FIG. 3 shows a sectional rendering along the rotational axis of a rotor that is embodied according to the invention in the installed state inside a gas turbine engine.

Of course, a sufficient extension of the projection 310 in the radially inner direction ri is still provided by the recessed edge sections 311*a* and 311*c*, so that a groove 3100 is present for the surrounded radially outer edge 43 of the securing plate 4 also in the area of a recessed edge section 311*a* or 311*c*. The radially inner edge 42 of a securing plate 4 is received inside a groove 2100 of the rotor base part 2 that is formed by a projection 210 that protrudes in the radially outer direction ra. In this way, it is ensured through the securing plate 4 that the individual rotor blades 3*a*, 3*b* are axially secured at the rotor base part 2 (cf. also FIG. 3) in the area of their respective blade root 32 which is at least partially covered by a securing plate 4.

In contrast to the solution known from the state of the art as it is shown in FIGS. 5A to 5D (cf. in particular FIG. 5D), it is further achieved through the recessed edge sections 311*a* and 311*c* that, with the edge section 311*b* being positioned intermediately along the circumferential direction U, the projection 310 extends further radially inward only in that area in which the fastening groove 20 is located. In this way, the edge section 311*b* projecting further radially inward is dimensioned in such a manner that the blade root 32 can be pushed in the axial direction through the fastening groove 20 and the gap that is thus defined between two webs 22 of the rotor base part 2 if the securing plate 4 is either not yet or no longer attached. This is not possible with a projection of a constant radial extension according to FIG. 5D. Here, the passing of the blade root 32 through a fastening groove 20 is blocked by the projection 310. The projection 310 cannot be pushed beyond the facing webs 22 of the rotor base part 2 that laterally delimit a fastening groove 20. In order to allow for a complete axial movability through the fastening groove 30, the radial extension of the blade root 32 and thus the length of a blade neck 320 would have to be increased in this case, so that a lower edge of the projection 310 extends further radially outside than the ends of the webs 22 throughout. However, this would be accompanied by an increase in the weight of a rotor blade 3*a*, 3*b*. In contrast to that, in the shown embodiment variant of a solution according to the invention, the additional mounting advantage can be realized without any disadvantage with respect to the weight.

Figure 2A:
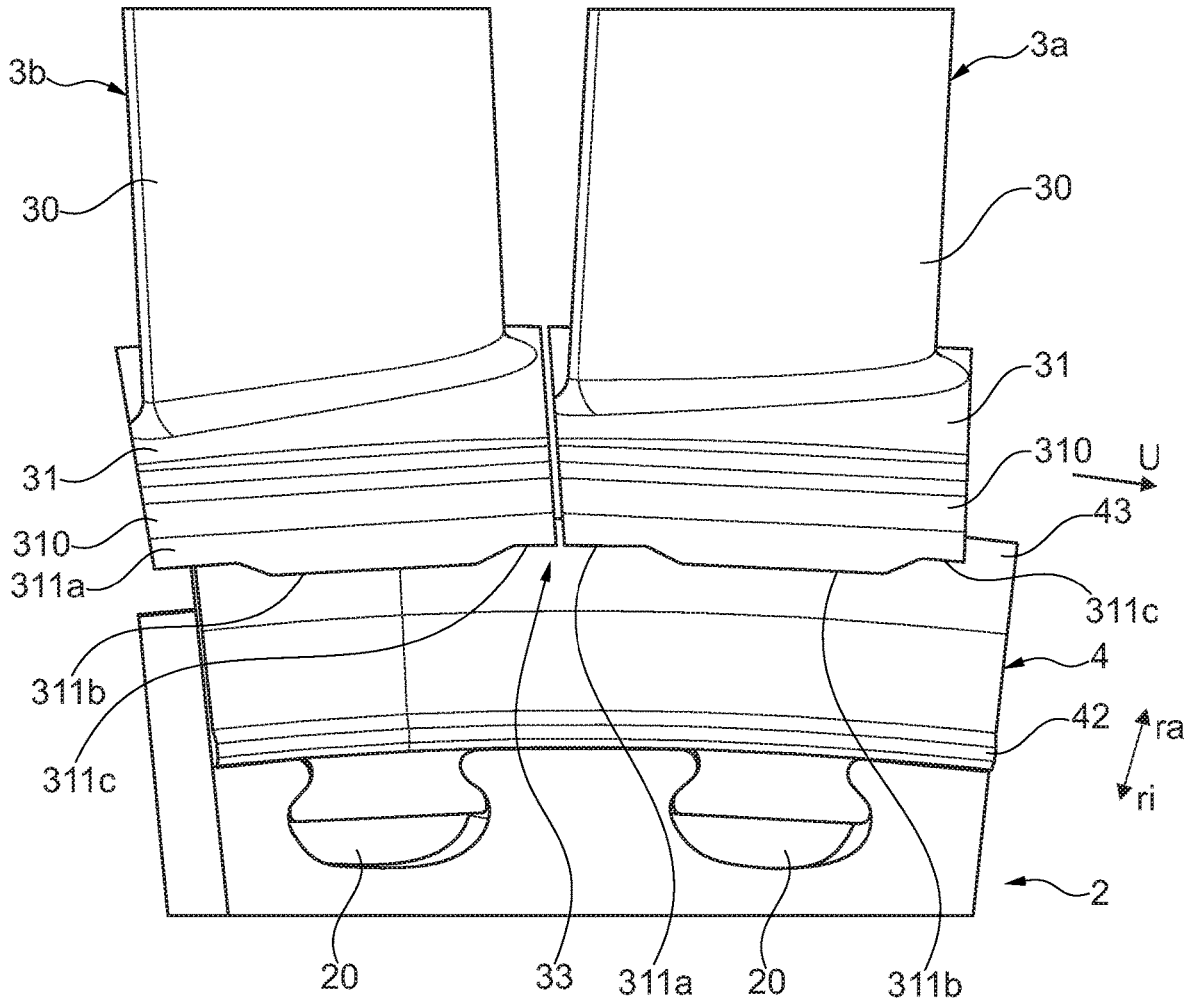
FIG. 2A shows, in a view that corresponds to the ones of FIGS. 1A and 1B, another embodiment variant with recessed edge sections having different geometrical designs at two projections of two rotor blades.
Figure 2B:
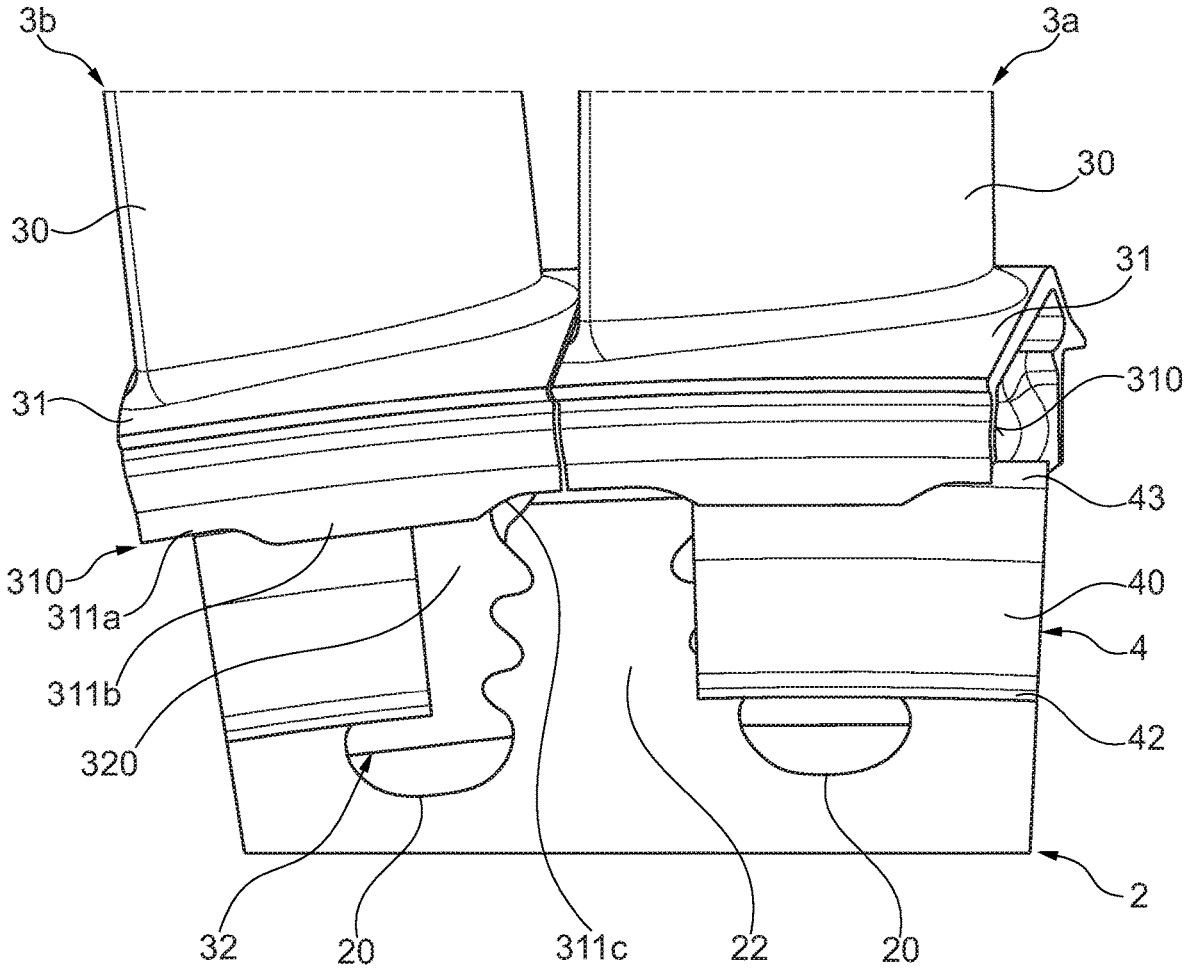
FIG. 2B shows, in a view that corresponds to the one of FIG. 1C, the rotor of FIG. 2A.

In the variant that is illustrated in FIGS. 2A and 2B, the shape of the recessed edge sections 311*a* and 311*c* is varied with respect to the variant of FIGS. 1A to 1C. Here, a projection 310 at a blade base 31 is embodied in a profiled manner, so that the two edge sections 311*a* and 311*b* of a rotor blade 3*a* or 3*b* that are arranged at a distance from each other along the circumferential direction U are embodied so as to be radially backset in the radially outer direction ra with respect to the middle third edge section 311*b* of the projection 310 of the respective rotor blade 3*a* or 3*b*. At that, the individual recessed edge sections 311*a* and 311*c* respectively have areas with a constant radial extension along the circumferential direction U. In other words, each of the recessed edge sections 311*a*, 311*c* of a rotor blade of FIGS. 2A and 2B has at least one area where a height of the respective recessed edge section 311*a*, 311*c* does not decrease in the circumferential direction U or opposite to the same.

In particular, it is achieved in this manner that a recess 33 defined in the area of the blade bases 31 of two neighboring rotor blades 3*a*, 3*b* is trapezoid as viewed along the rotational axis of FIG. 2, while the recess 33 in the variant of FIGS. 1A to 1C is triangular. If the lower edges of the recessed edge sections 311*a*, 311*c* extend in a more rounded manner, an elliptical recess can also be formed in a possible further development.

A cutting manufacturing method or thermal material removal can be provided for manufacturing the recessed edge sections 311*a*, 311*c* at a rotor blade 3*a* or 3*b*. Thus, in the embodiment variant of FIGS. 1A to 1C, the recessed edge sections 311*a* and 311*c* can be manufactured in a comparatively simple manner by means of sanding, for example. A profiled embodiment according to the variant of FIGS. 2A and 2B can for example be manufactured by means of erosion. Here, the manufacture of the recessed edge sections 311*a* and 311*c* can be performed at the rotor blades 3*a*, 3*b* in one work step with damper pockets (not shown here) or other functional areas, which are usually also manufactured by means of erosion.

Based on FIG. 2B it is also illustrated in correspondence with FIG. 1C that, also in this embodiment variant, the blade root 32 can be pushed through a fastening groove 20 in the axial direction without being blocked by the projection 31 thanks to the recessed edge sections 311*a* and 311*c*, with the securing plate being partially omitted in the rendering. The (middle) edge section 311*b* that projects further radially inward is dimensioned in such a manner that it fits through the gap defined between two webs 22 of the rotor base part 2 at the upper end of the fastening groove 20.

Figure 4:
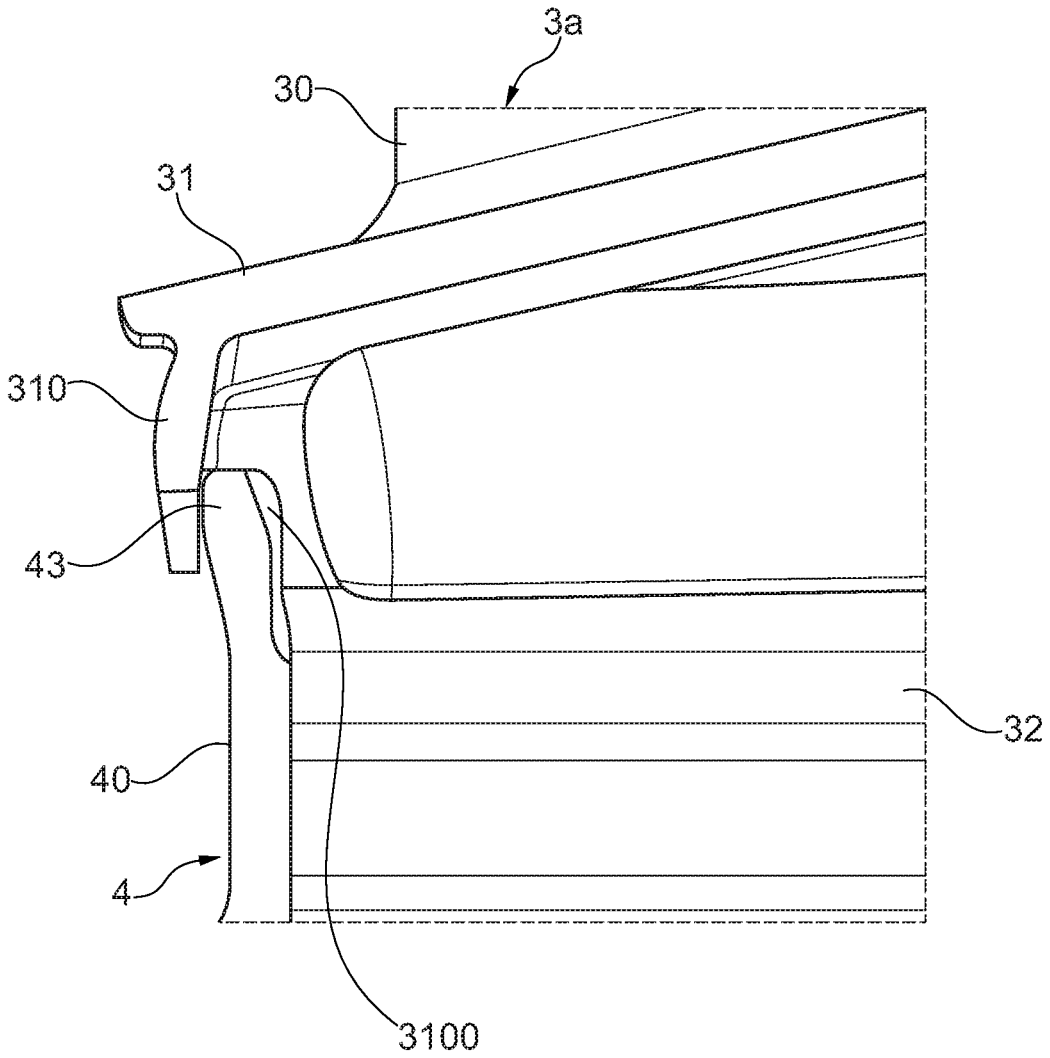
FIG. 4 shows, in sections, a sectional rendering of the rotor that is obtained along a section line that is parallel to the rotational axis of the rotor.
Figure 5A:
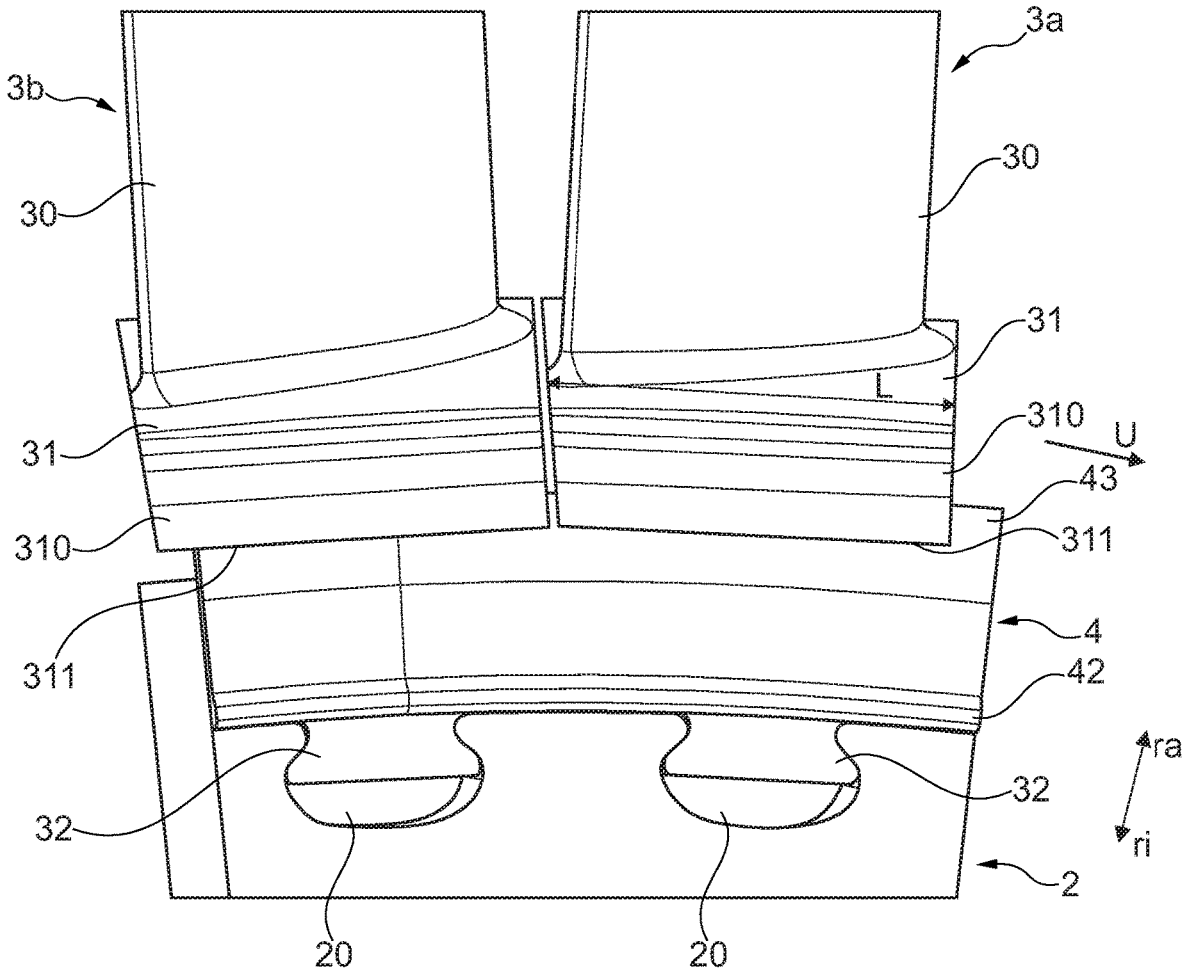
FIGS. 5A-5D show, respectively in sections, a rotor as it is known from the state of the art with two neighboring rotor blades, with their projections being shown with a linear edge and thus with lower edges that are nominally aligned with each other (FIG. 5A), as well as lower edges (FIGS. 5B and 5C) that may be offset with respect to one another due to tolerances, and with a securing element (FIG. 5D) being partially omitted.
Figure 5B:
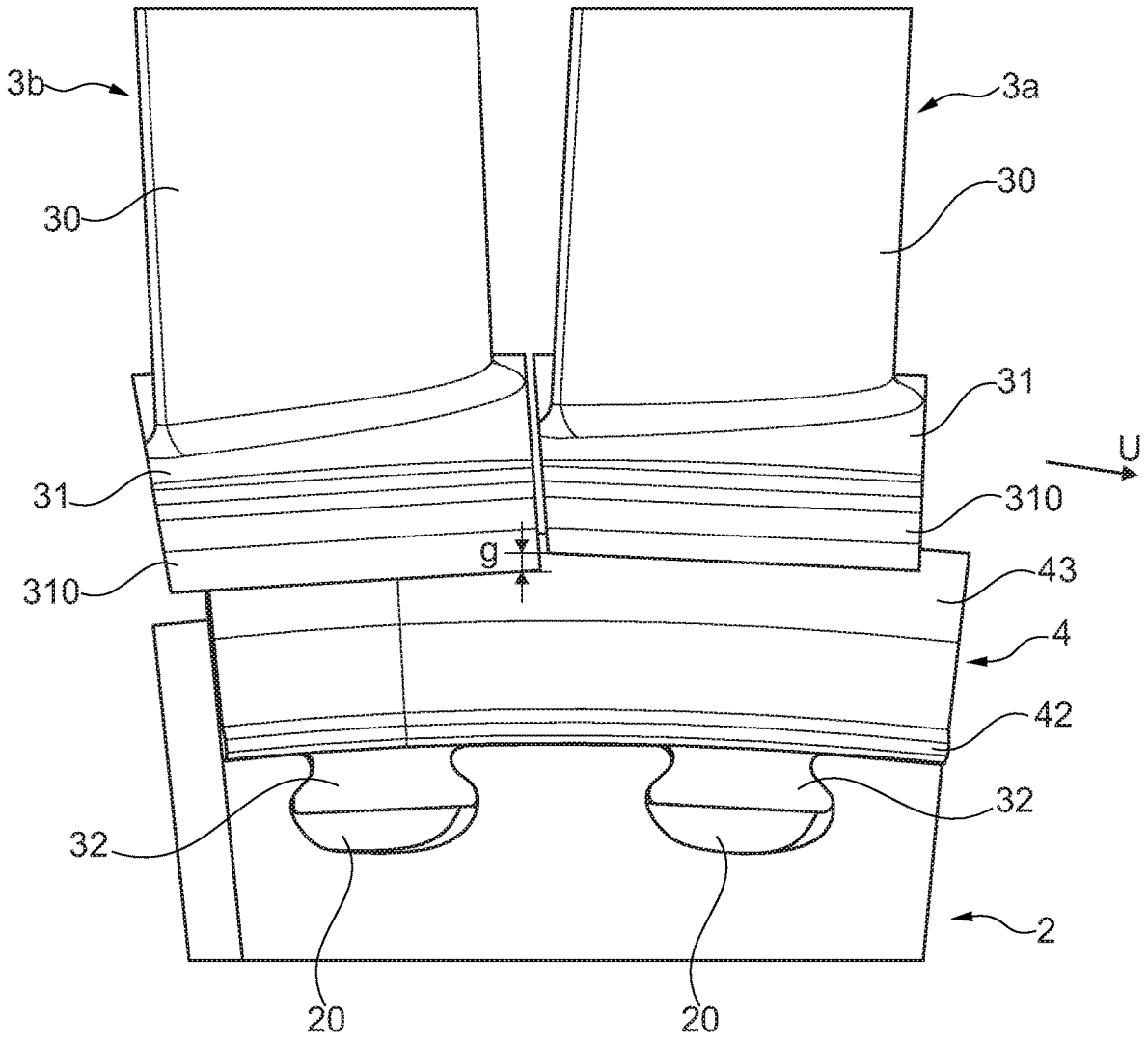
Figure 5C:
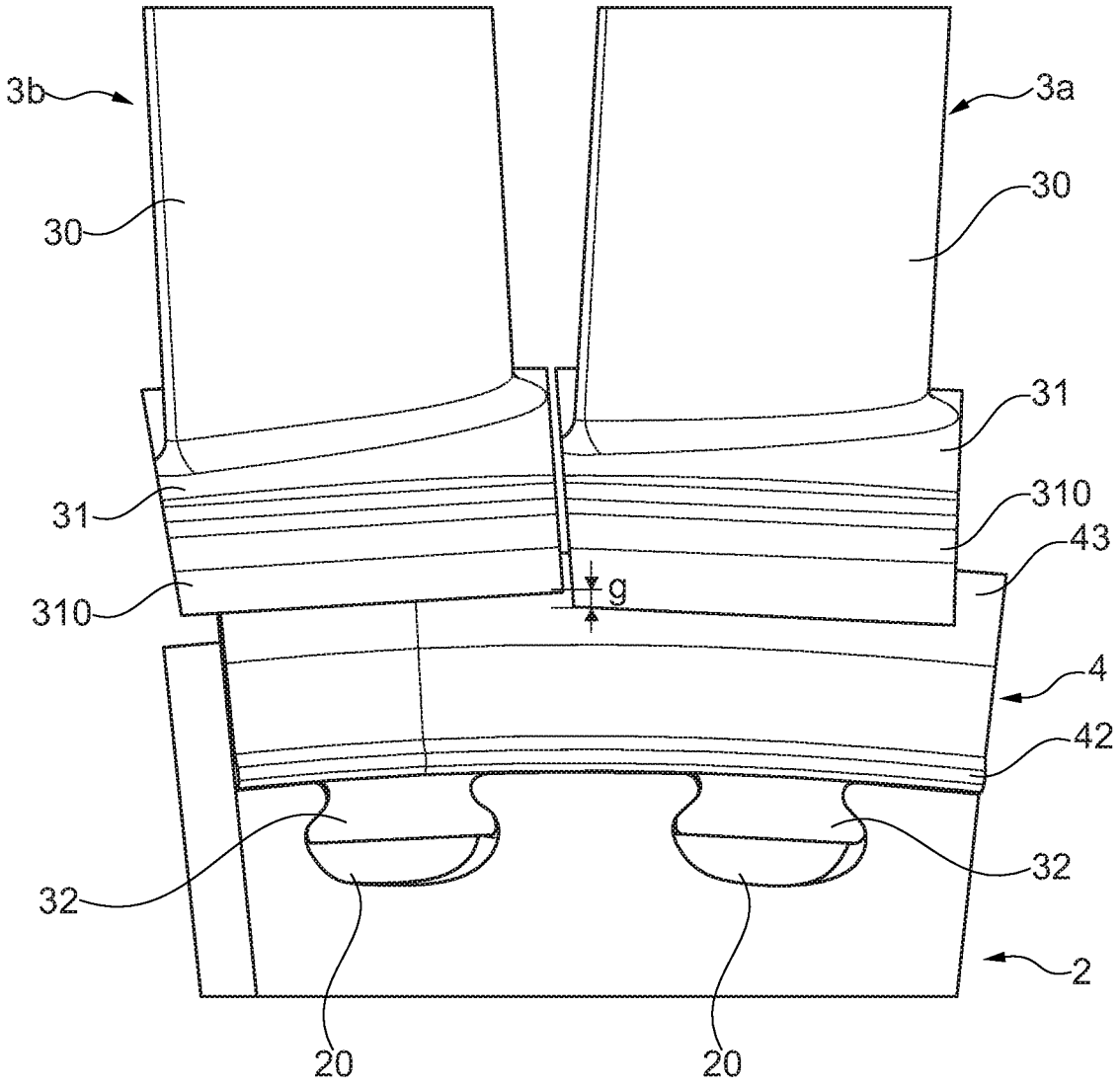
Figure 5D:
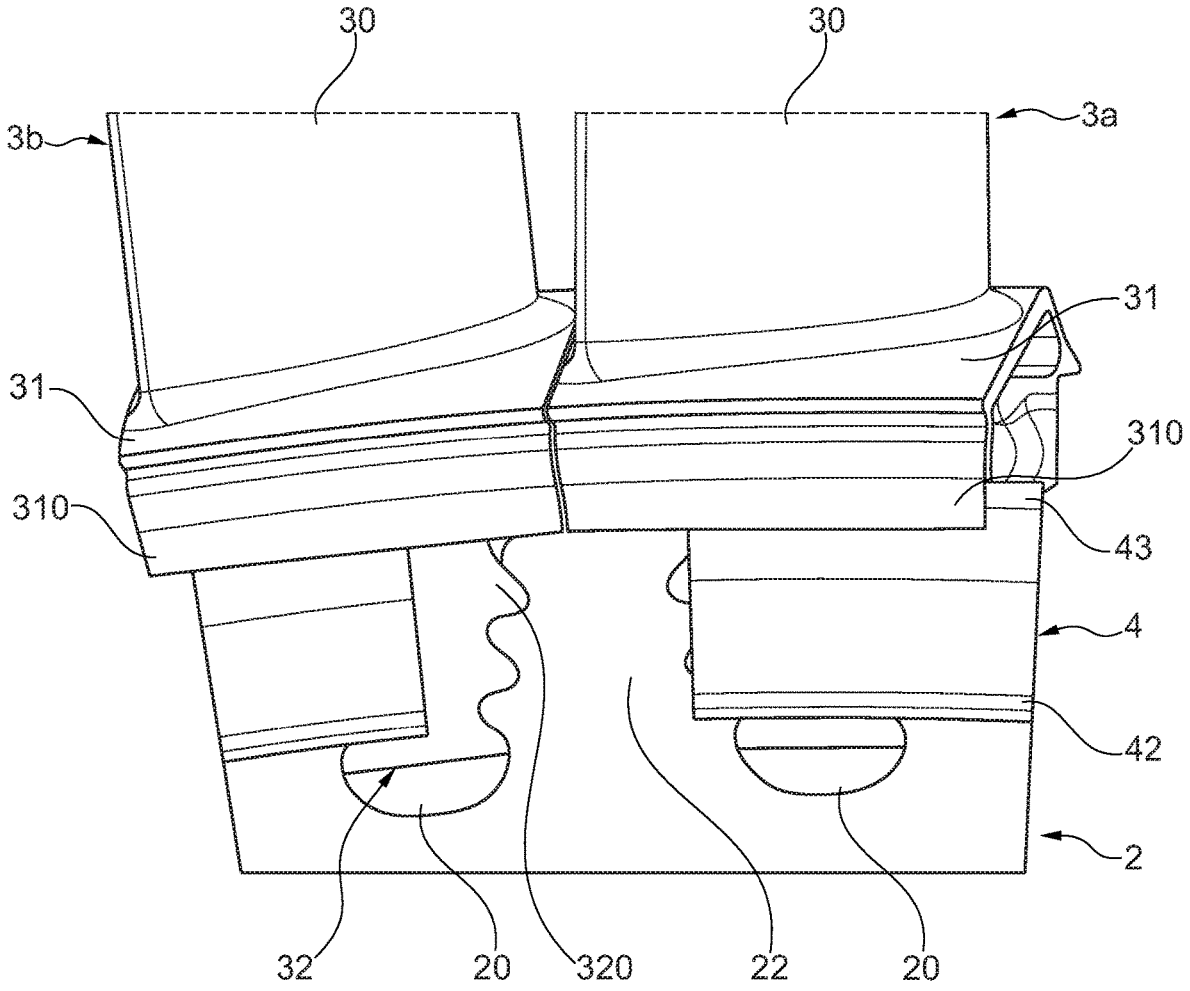

Based on the sectional rendering of a longitudinal section according to FIG. 4, the design of the securing plate 4 is illustrated separately. The securing plate 4 has a central area 40 that is located between the radially inner and radially outer edges 42 and 43. It can in particular be seen from FIG. 4 how a radially outer edge 43 of the securing plate 4 is received inside the groove 3100 of the blade base 31 of a rotor blade 3*b*, and is surrounded by the projection 310 that extends radially inward, while the central area 40 extends outside of the groove 3100 along the blade root 32.

PARTS LIST

T gas turbine engine
11 low-pressure compressor
12 high-pressure compressor
13 high-pressure turbine
14 medium-pressure turbine
15 low-pressure turbine
2 rotor base part
20 fastening groove
210 projection
2100 groove
22 web
30 blade leaf
31 blade base
310 projection
3100 groove
311 edge
311*a*, 311*b*, 311*c* edge section
32 blade root
320 blade neck
33 radial recess
3*a*, 3*b* rotor blade
4 securing plate (securing element)
40 central area
42 inner edge
43 outer edge
5 annular gap
6 guide vane arrangement
A outlet
a1, a2 length
B bypass channel
BK combustion chamber section
b1, b2 height
c width
d minimal width of the blade neck
E inlet/intake
F fan
g offset
L total length
M central axis/rotational axis
R entry direction
ra, ri radial direction
TT turbine
U circumferential direction
V compressor

The invention claimed is:

1. A rotor for an engine, comprising:

a rotor base including a plurality of fastening grooves located in the rotor base, wherein the plurality of fastening grooves are arranged in succession around a rotational axis along a circumferential direction of the rotor;

at least one rotor blade, wherein the at least one rotor blade further comprises:

a blade leaf at a radially outer end of the at least one rotor blade;

a blade root at a radially inner end of the at least one rotor blade, and wherein the blade root is supported in a form-fit manner inside one of the plurality of fastening grooves; and a blade base located between the blade leaf and the blade root, wherein the blade base further comprises:

a projection extending radially inward to form a projection groove;

wherein the projection includes a radially inner edge including a bottom edge portion and at least one recessed portion positioned to a circumferential side of the bottom edge portion; and wherein the at least one recessed portion extends a radially outward height from the bottom edge portion, and wherein the at least one recessed portion extends away from the bottom edge portion with a length along the circumferential direction of the rotor that corresponds to at least three times a maximum of the radial outward height by which the at least one recessed portion is recessed; and at least one securing plate arranged about the rotor base, wherein the at least one securing plate includes a radially inner edge and a radially outer edge;

wherein the radially inner edge is attached in a form-fit manner to the rotor base; and wherein the radially outer edge is attached with a form-fit connection to the blade base, wherein the radially outer edge fits in the projection groove, and wherein the projection at least partially surrounds the radially outer edge.

2. The rotor according to claim 1, further comprising a platform at a radially outer edge of the projection, wherein a radial distance from the platform to the at least one recessed portion is less than a radial distance from the platform to the bottom edge portion.

3. The rotor according to claim 1, wherein the at least one recessed portion extends in a manner at least partially tilted with respect to the circumferential direction.

4. The rotor according to claim 1, wherein the radially outward height of the at least one recessed portion is at least 0.5 mm from the bottom edge portion.

5. The rotor according to claim 4, wherein the radially outward height of the at least one recessed portion is at least 0.8 mm from the bottom edge portion.

6. The rotor according to claim 4, wherein the radially outward height of the at least one recessed portion is at least 1 mm from the bottom edge portion.

7. The rotor according to claim 1, wherein the at least one recessed portion includes a first recessed portion and a second recessed portion.

8. The rotor according to claim 7, wherein the first recessed portion and the second recessed portion have at least one chosen from different dimensions and different lengths along the circumferential direction.

9. The rotor according to claim 7, wherein the first recessed portion and the second recessed portion are arranged at a distance from each other along the circumferential direction.

10. The rotor according to claim 7, wherein one of the first recessed portion and the second recessed portion is recessed with respect to the bottom edge portion by at least a length of the bottom edge portion in the circumferential direction, and wherein at least one chosen from a nominal position of the bottom edge portion with respect to the fastening groove and a projection of an adjacent rotor blade is predefined based on the length of the bottom edge portion in the circumferential direction.

11. The rotor according to claim 1, wherein the at least one rotor blade includes a plurality of rotor blades, wherein the plurality of rotor blades includes a first rotor blade and a second rotor blade circumferentially arranged adjacent to one another, wherein the at least one recessed portion of the first rotor blade and at least one recessed portion of the second rotor blade are circumferentially arranged adjacent to one another to form a recess of a defined minimum length and a minimum height.

12. The rotor according to claim 11, wherein the recess is one chosen from elliptical, trapezoidal, and triangular as viewed along the rotational axis.

13. The rotor according to claim 11, wherein the plurality of rotor blades are positioned circumferentially adjacent to one another to provide a plurality of recesses along the circumferential direction, wherein the plurality of recesses have a defined minimum length and a minimum height.

14. The rotor according to claim 1, wherein the at least one recessed portion is created by mechanical material removal.

15. The rotor according to claim 1, wherein the at least one recessed portion is created by thermal material removal.

16. The rotor according to claim 1, wherein the at least one rotor blade includes a plurality of rotor blades, wherein the at least one securing plate axially secures at least two of the plurality of rotor blades with respective projections, and wherein the radially outer edge of the securing plate is surrounded by the respective projections of the at least two of the plurality of rotor blades.

17. A rotor for an engine, comprising:

a rotor base including a plurality of fastening grooves located in the rotor base, wherein the plurality of fastening grooves are arranged in succession around a rotational axis along a circumferential direction of the rotor;

at least one rotor blade, wherein the at least one rotor blade further comprises:

a blade leaf at a radially outer end of the at least one rotor blade;

a blade root at a radially inner end of the at least one rotor blade, and wherein the blade root is supported in a form-fit manner inside one of the plurality of fastening grooves; and a blade base located between the blade leaf and the blade root, wherein the blade base further comprises:

a projection extending radially inward to form a projection groove;

wherein the projection includes a radially inner edge including a bottom edge portion and at least one recessed portion positioned to a circumferential side of the bottom edge portion; and wherein the at least one recessed portion extends a radially outward height of at least 0.5 mm from the bottom edge portion, and wherein the at least one recessed portion extends away from the bottom edge portion in the circumferential direction of the rotor; and at least one securing plate arranged about the rotor base, wherein the at least one securing plate includes a radially inner edge and a radially outer edge;

wherein the radially inner edge is attached in a form-fit manner to the rotor base; and wherein the radially outer edge is attached with a form-fit connection to the blade base, wherein the radially outer edge fits in the projection groove, and wherein the projection at least partially surrounds the radially outer edge.

18. The rotor according to claim 17, wherein the radially outward height of the at least one recessed portion is at least 0.8 mm from the bottom edge portion.

19. The rotor according to claim 17, wherein the radially outward height of the at least one recessed portion is at least 1 mm from the bottom edge portion.

* * * * *